US009039438B2

(12) United States Patent
Gunreben et al.

(10) Patent No.: US 9,039,438 B2
(45) Date of Patent: May 26, 2015

(54) AIRBAG CONNECTOR SYSTEM

(75) Inventors: Michael Gunreben, Schwanstetten (DE); Vincent Regnier, Nuremberg (DE)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 17 days.

(21) Appl. No.: 14/112,053

(22) PCT Filed: Apr. 23, 2012

(86) PCT No.: PCT/EP2012/057412
§ 371 (c)(1),
(2), (4) Date: Oct. 16, 2013

(87) PCT Pub. No.: WO2012/143570
PCT Pub. Date: Oct. 26, 2012

(65) Prior Publication Data

US 2014/0045361 A1 Feb. 13, 2014

(30) Foreign Application Priority Data

Apr. 22, 2011 (WO) ..... PCT/IB2011/001219

(51) Int. Cl.
*H01R 13/627* (2006.01)

(52) U.S. Cl.
CPC ..... *H01R 13/6275* (2013.01); *H01R 13/6272* (2013.01); *H01R 13/627* (2013.01); *H01R 13/6273* (2013.01)

(58) Field of Classification Search
CPC ..... H01R 13/627; H01R 13/6272
USPC ..... 439/352
See application file for complete search history.

(56) References Cited

U.S. PATENT DOCUMENTS

| | | | | |
|---|---|---|---|---|
| 6,530,799 | B2 | 3/2003 | Regnier | |
| 6,544,060 | B2 * | 4/2003 | Wakui et al. | 439/188 |
| 2006/0216983 | A1 * | 9/2006 | Langhoff et al. | 439/352 |

FOREIGN PATENT DOCUMENTS

| | | | |
|---|---|---|---|
| DE | 202 16 337 | U1 | 12/2002 |
| EP | 0 601 522 | A2 | 6/1994 |

(Continued)

OTHER PUBLICATIONS

International Search Report dated Aug. 23, 2012.

(Continued)

*Primary Examiner* — Abdullah Riyami
*Assistant Examiner* — Justin Kratt
(74) *Attorney, Agent, or Firm* — Robert J. Myers

(57) ABSTRACT

The present invention relates to a connector system comprising a plug connector and a retainer configured to be inserted into a corresponding holder. The plug connector comprises a connector housing and a latching arm assigned to the connectorhousing, whereby the plug connector is configured to be mountable with the retainer. The connector system comprises a deflection portion for causing the latching arm to deflect upon mounting of the plug connector with the retainer. The deflection portion is shaped such that the deflection provides increasing resistance against further movement of the plug connector. The connector system further comprises a release portion configured to enable a release deflection of the latching arm. The release portion is shaped so the release deflection does not provide resistance against further movement of the plug connector. Still further, the connector system comprises a latching portion configured to allow the latching arm to lock the plug connector.

26 Claims, 5 Drawing Sheets

(56) References Cited

FOREIGN PATENT DOCUMENTS

| | | | |
|---|---|---|---|
| EP | 1 207 591 | A2 | 5/2002 |
| EP | 2 230 731 | A1 | 9/2010 |
| FR | 2 788 890 | | 7/2000 |
| WO | 2009/053778 | A1 | 4/2009 |

OTHER PUBLICATIONS

English Machine Translation of EP 2 230 731, published Sep. 22, 2010.

* cited by examiner

AIRBAG CONNECTOR SYSTEM

CROSS-REFERENCE TO RELATED APPLICATION

This application is a national stage application under 35 U.S.C. §371 of PCT Application Number PCT/EP2012/057412 having an international filing date of Apr. 23, 2012 which designated the United States, which PCT application claimed the benefit of PCT Application Number PCT/IB2011/001219, filed Apr. 22, 2011, the entire disclosure of each of which are hereby incorporated herein by reference.

TECHNICAL FIELD OF THE INVENTION

The present invention relates to a connector system comprising a plug connector and a retainer, both configured to be connected to a corresponding socket, whereby an electrical connection between the plug connector and the socket can be established only when the connector system is correctly assembled.

BACKGROUND OF THE INVENTION

In many fields of applications it is important that save coupling between connectors and corresponding counter connectors can be guaranteed. In particular in the case of automotive safety restraint systems as for example airbag systems in passenger vehicles, plug connectors used for the connection of an airbag to its ignition base, i.e. to a squib socket, have to be provided with reliable safety systems. Typically, to this end these plug connectors are provided with connector position assurance (CPA) members which can be inserted into a locked position on the plug connector only if the plug connector is appropriately connected to the airbag squib socket. In this position, the CPA member provides additional security for the mated state of plug connector and squib socket, and typically the CPA member is constructed such that an operator can visibly detect if the CPA member is inserted correctly into its locked position. Thus, thereby a correct and safe mating between the connector and the counter connector can be guaranteed.

An example of a plug connector provided with a CPA member is disclosed in document EP 1207591 A2. Therein, a plug connector is described which can be connected to a squib socket of an airbag connector system. In assembled condition, when the plug connector is inserted into the airbag squib socket, the plug connector is fixed inside the socket by means of flexible latching arms. During insertion of the plug connector into the socket, these arms bend inwardly until locking projections provided on the latching arms snap into corresponding latching recesses of the airbag squib socket.

In order to further secure the mating of the plug connector with the airbag squib socket a CPA member is provided. When the plug connector is inserted into the airbag squib socket and the locking projections are snapped into the latching recesses, the CPA member can be inserted into a housing of the plug connector. The CPA member comprises locking arms which upon insertion move into slots in between faces of the plug connector housing and the latching arms. Once these locking arms are inserted into the slots, bending of the latching arms is blocked and thus the latching arms are fixed inside of the recesses and the mating of plug connector and airbag squib socket is secured. According to EP '591, only when the connectors are correctly mated, the CPA member can be moved into the locked position in which it secures the mated state of the connectors. This can be visibly detected by an operator and thus it is possible to guarantee the correctly mated state of the connectors.

Even though the solution as proposed in the EP '591 works satisfactory, for certain applications the use of a CPA member is undesirable for example because of space limitations. An example of a plug for the connection to a squib socket without a CPA member is disclosed in document DE 20216337 U1. The plug connector disclosed therein is an example of a so called "scoop-proof" plug connector which is provided with a connection tube surrounding electrical contacts of the plug connector. This connection tube is designed such that upon mating of the plug connector to a squib socket, contact terminals of the plug connector can be connected only correctly to corresponding contact pins of the airbag squib socket. In the case that the plug connector is not correctly inserted into the airbag squib socket, the connection tube abuts the airbag squib socket such that false connection of the contact terminals to the contact pins is prevented.

To mechanically connect the plug connector to a squib socket, the plug connector is provided with latching arms which are attached to the connection tube such that upon insertion of the plug connector into the socket, the latching arms bend inwardly and upon full insertion of the plug connector into the airbag squib socket, locking projections provided on the latching arms snap into corresponding latching recesses of the airbag squib socket.

A further example of a plug connector to be connected to a squib socket without a CPA member is disclosed in document EP 2230731 A1. Therein, similar to the above described example, a "scoop-proof plug connector is described whereby this plug connector can be connected to a corresponding squib socket by means of latching arms which are mounted to flexible portions provided on a connection tube of the plug connector. Due to the flexibility of the latching arms, upon insertion of the plug connector into the airbag squib socket, the locking arms bend inwardly and upon full insertion of the plug connector, locking projections provided on the latching arms snap into recesses of the socket to lock the plug connector to the airbag squib socket.

The latching arms of the EP '731 are further provided with release members which, in mated condition of the plug connector with the airbag squib socket, can be actuated by an operator, i.e. they can be pressed inwardly to release the locking projections from the locking recesses. Thereby, the plug connector is free to be removed from the socket. Even though the latter two plug connectors are provided with reliable locking mechanisms and can be connected to squib sockets without CPA members, both plug connectors lack the possibility to visibly detect the mated state of the plug connectors to squib sockets.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

A connector system is provided which comprises a plug connector and a retainer which is configured to be inserted into a corresponding socket. The plug connector comprises a connector housing and at least one latching arm assigned to the connector housing, whereby the plug connector is configured to be mountable with the retainer. For example, the latching arm can be mounted to the connector housing or can be formed as an integral part of the connector housing.

As it will be clear for the person skilled in the art, the retainer can be mountable inside of the socket and can be provided with shorting means, as e.g. a shorting clip, to short-circuit electrical connection pins of the socket. The plug connector can be provided with means for deactivating the short circuit upon inserting the plug connector into the socket. In one embodiment, the retainer also serves as a mechanical connection member between the plug connector and the socket, i.e. the plug connector is mechanically coupled to the socket via the retainer. Thereby, advantageously locking elements of the plug connector such as the latching arm are not constrained in dimension or function by dimension and design of the socket which, as it is known to the person skilled in the art, usually is a predefined component. In one embodiment, the connector system is not provided with locking elements for direct mechanical coupling of the plug connector to the socket.

The connector system comprises at least one deflection portion for causing a deflection of the latching arm upon mounting of the plug connector with the retainer, whereby the deflection portion is shaped such that the deflection provides increasing resistance against further movement of the plug connector into the retainer. In one embodiment, the latching arm is provided with an inwardly directed latching projection which is configured to engage the deflection portion upon mounting of the plug connector with the retainer such that the latching arm is deflected outwardly in a direction essentially perpendicular to the mounting direction. For example, due to the deflection of the latching arm by the deflection portion, the latching arm can be biased against the deflection portion. Upon further movement of the plug connector towards the socket, the deflection increases, thereby also increasing the bias of the latching arm and thus providing increasing resistance against further movements of the plug connector.

The connector system comprises at least one release portion configured to enable a release deflection of the latching arm whereby the release portion is shaped such that the release deflection does not provide resistance against further movement of the plug connector. For example, the release portion can be shaped such that if the latching arm is biased against the release portion and the plug connector is moved towards the socket, the latching arm is deflected such that the bias decreases. Thus, no force has to be applied for deflecting the latching arm and thereby no resistance is provided against further movement of the plug connector.

The connector system comprises at least one latching portion configured to allow latching of the latching arm for locking of the plug connector. For example, upon full insertion of the plug connector into the socket, the latching arm can latch behind a stop surface of the connector system to lock the plug connector in the fully inserted position to the socket. The deflection portion, the release portion and the latching portion can be provided all on the retainer or all on the latching arm. Alternatively, one or two of these portions can be provided on the retainer while the other one or two of these portions can be provided on the latching arm. The deflection portion, the release portion and the latching portion are all provided on the retainer.

The deflection portion and the release portion may be arranged such that upon mounting of the plug connector with the retainer the resistance provided by the deflection of a latching arm reaches a threshold value before the release deflection of the latching arm is enabled. For example, the deflection portion and the release portion can be arranged such that the latching arm engages the deflection portion before it can engage the release portion. Upon engagement of the latching arm with the deflection portion and movement of the plug connector towards the socket the latching arms can be deflected outwardly.

Thereby, due to increasing deflection of the latching arms upon movement of the plug connector, the latching arms are increasingly biased or pressed against the deflection portion due to an increasing spring force of the latching arms. Thus, the resistance against further movement, i.e. the insertion force increases, up to a threshold value. In one embodiment, the threshold value corresponds to a magnitude of insertion force within the range of 1 Newton to 100 Newtons (N), preferably within the range of 10 N to 90 N, more preferably within the range of 20 N to 80 N, even more preferably within the range of 30 N to 70 N, yet even more preferably within the range of 30 N to 60 N, and most preferably within the range of 35 N to 45 N.

The deflection portion, the release portion and the latching portion may be provided integrally on a so called Go/No Go member, whereby the release portion is disposed in between the deflection portion and the latching portion. A resulting Go/No Go mechanism can be as follows. Upon insertion of the plug connector into the socket, the latching arm of the plug connector engages the deflection portion. Upon further movement of the plug connector in insertion direction, the resistance against further movement increases due to increasing deflection of the latching arm. After the resistance has reached a threshold value, the latching arm comes into engagement with the release portion. From there on, no resistance is provided against further movement of the plug connector in insertion direction and when the plug connector is fully inserted and the latching arm has passed the release portion, the latching arm latches to the latching portion, i.e. for example a latching projection of the latching arm latches behind a stop surface of the latching portion, such that the plug connector is locked in its fully inserted position.

This mechanism is referred to as a Go/No Go mechanism because, in the case that the plug connector is inserted into the socket by a human operator with not enough force, the plug connector is not inserted. In the other case, when the operator presses with enough force to overcome the resistance, due to a relatively large resulting pressing momentum, the operator cannot stop leaving the plug connector inserted only half-way, but will automatically press the plug connector into its fully inserted position.

In an alternative embodiment according to the invention, a connector system comprising a plug connector and a retainer is provided, whereby the retainer is configured to be inserted into a corresponding socket. The plug connector comprises a connectorhousing and at least one latching arm which is assigned to the connector housing. The plug connector is configured to be mountable with the retainer. The latching arm comprises an inwardly directed latching projection which is configured to be latched against a latching portion of the retainer when the plug connector is mounted with the retainer to lock the plug connector to the retainer. Thereby, advantageously the plug connector is locked to the retainer which in one embodiment is provided with coupling members to mechanically couple the retainer to the socket. Thus, in assembled condition of the connector system the plug connector is mechanically connected to the socket via the interaction of latching projection of the latching arm with the retainer.

In a further alternative embodiment, a connector system is provided which comprises a plug connector and a retainer whereby the retainer is configured to be inserted into a corresponding socket. The plug connector comprises a connector housing and at least one latching arm assigned to the connector housing and the plug connector is configured to be mountable with the retainer. The latching arm comprises a latching section configured to mechanically connect to a latching portion of the retainer and a release member configured to be actuated to release the latching section from the latching portion. The latching arm is pivotably connected to the connector housing via a pivot member disposed between the latching section and the release member such that upon actuation of the release member, the latching section is released from the latching portion.

The plug connector may comprise at least one contact element configured to electrically contact a contact member of the socket when a plug connector is mounted to the retainer and the retainer is mounted to the socket. Thereby, when the retainer is mounted to the socket, upon mounting of the plug connector to the retainer the electrical contact element does not come into electrical contact with the contact member when the plug connector is in a position in which the latching arm is deflected by the deflection portion.

Thereby, if for example the deflection portion is a first part of a Go/No Go member as described above, it is assured that the electrical connection between plug connector and socket can only be established after the plug connector is moved past this first, blocking portion of said Go/No Go mechanism. Thus, the electrical and mechanical coupling of plug connector and socket can only be achieved at the same time. Further, while the latching arm is deflected by the deflection portion, for example when the plug connector is positioned in the first, blocking position of the Go/No Go mechanism, an operator can visibly detect that the plug connector is not yet correctly coupled to the socket. Thus, the above described Go/No Go mechanism can provide a visible detection means such that an operator can guarantee the correctly mated state of plug connector and socket when the plug connector is fully inserted into the assembled airbag connector system. Further, it is also possible to detect the mated state of the plug connector and socket electrically, because as described above electrical and mechanical connection of the plug connector in the connector system can only be achieved at the same time.

It is to be noted that embodiments may include an airbag connector system in which the retainer is an "airbag squib" retainer and the socket is a so called "airbag squib" socket.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
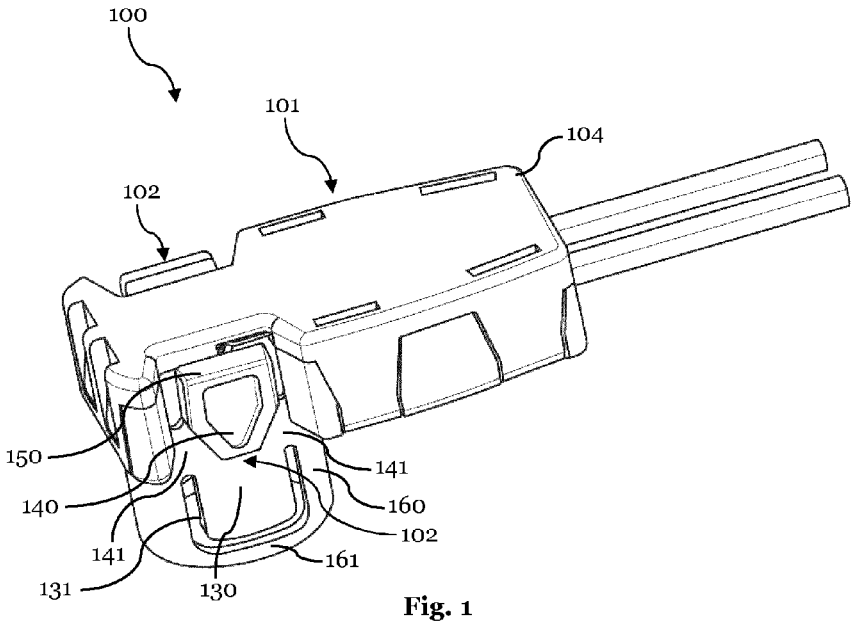
FIG. 1 shows a schematic illustration of a plug connector to be used in connection with an airbag connector system.

FIG. 1 shows a plug connector 100 to be used in connection with an airbag connector system. The plug connector 100 is provided with a connector housing 101 which is closed by a lid 104. The connector housing 101 is provided with a connection tube 160 with a safety ring 161. The plug connector 100 is further provided with two latching arms 102 which are formed integrally with the connection tube 160. Latching sections 130 of the latching arms 102, which are provided with inwardly directed latching projections 131 (see also FIG. 2), are cut out of the connection tube 160. The latching arms 102 are connected to the connection tube 160 via flexible portions (connection bridges) 141 which are parts of intermediate portions of the latching arms 102. Further, the latching arms 102 are provided with release members 150 which can be pressed inwardly towards the connector housing 101 such that the latching arms 102 can be pivoted around pivot members 140, i.e. around said intermediate portions in between the flexible portions 141.

Figure 2:
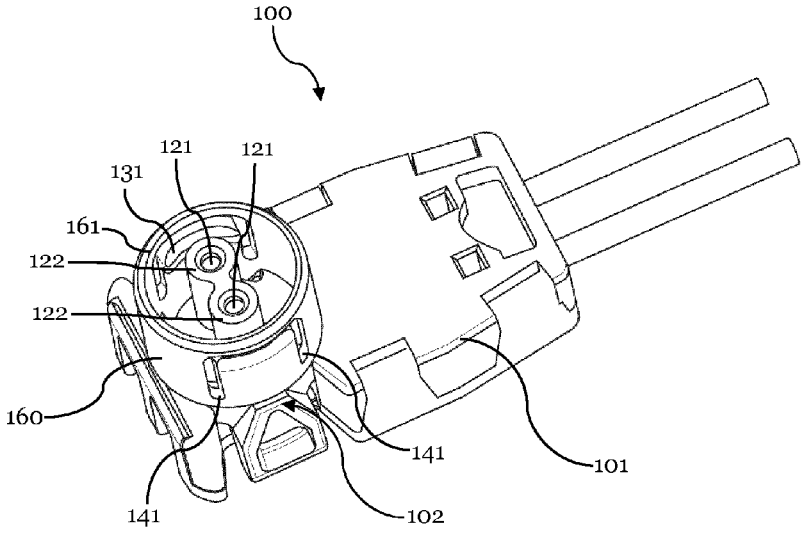
FIG. 2 shows the plug connector of FIG. 1 from a different perspective.

As illustrated in FIG. 2, the connection tube 160 surrounds two contact terminals 121 which are received within isolation tubes 122 connected to the connector housing 101. As it will be clear to the person skilled in the art, the plug connector 100 is a "scoop-proof" plug connector, i.e. if the plug connector 100 is inserted incorrectly into a corresponding squib socket 300 (shown in FIGS. 4 to 6), for example at a false angle, the safety ring 161 will abut a portion of the socket 300 such that further insertion and in particular damage to the contact pins 221 is prevented. Thus, the contact terminals 121 can only come into contact for example with corresponding contact members, i.e. contact pins 221 of the socket 300 if the plug connector 100 is correctly oriented to be inserted. Herein, it is referred to (female) contact terminals 121 of the plug connector 100 and contact pins 221 of the socket 300. However, as it will be obvious for the person skilled the art, that alternatively the plug connector can be provided with contact pins while the socket can be provided with contact terminals.

Figure 3:
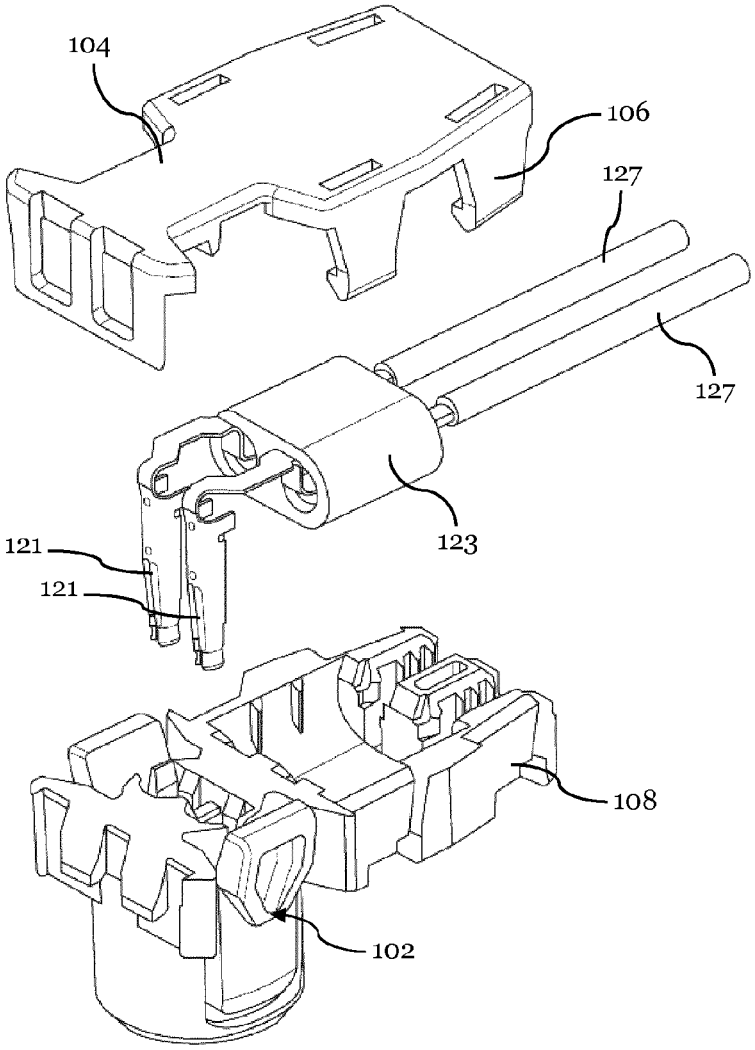
FIG. 3 shows an exploded illustration of the parts of the plug connector of FIGS. 1 and 2.

FIG. 3 shows an exploded view of the parts of the plug connector 100, whereby the lid 104 has been disconnected from the connector housing 101 such that the interior components become visible. As one may derive from FIG. 3, in assembled condition, latching tongues 106 which are provided on either side of the lid 104 (only two are visible due to the perspective) latch behind corresponding latching faces 108 to lock the lid 104 to the connector housing 101. In between the lid 104 and the connector housing 101, one can see electrical contact elements of the plug connector 100, i.e. contact terminals 121 which are in electrical connection with cables 127 which in assembled condition of the connector system serve for example to connect the socket 300 to airbag control electronics. In between the cables 127 and the contact terminals 121 a ferrite element is shown.

Figure 4:
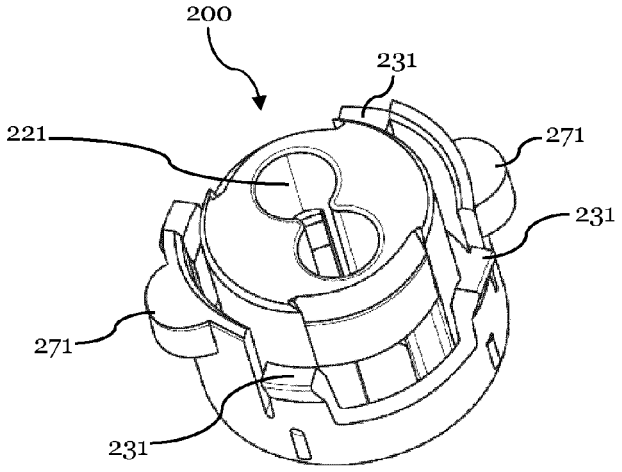
FIG. 4 shows a retainer configured to be used in connection with an airbag connector system.
Figure 5:
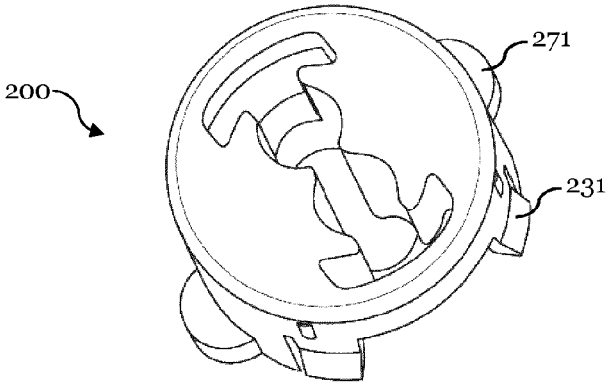
FIG. 5 shows the retainer of FIG. 4 from a different perspective.
Figure 6:
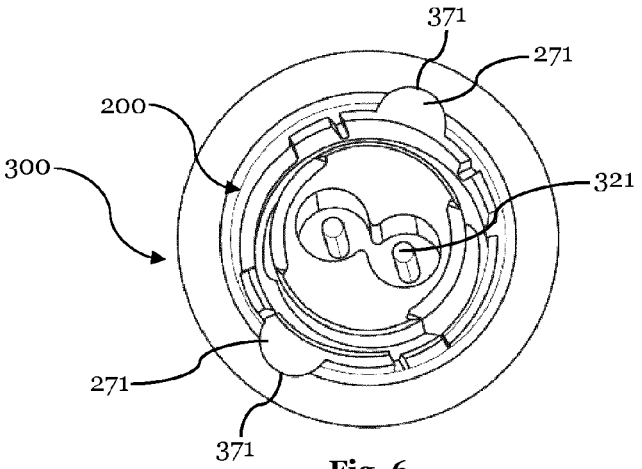
FIG. 6 shows the retainer of FIGS. 4 and 5 mounted to an socket.

FIGS. 4 to 6 show a retainer 200. The retainer 200 is configured to be inserted into a socket 300 and is therefore provided with coupling elements 231, i.e. stop latches 231, for locking the retainer 200 inside of a socket 300 as shown in FIG. 6. The retainer 200 is provided with an 8-shaped opening 221 which in assembled condition of retainer 200 and socket 300 surrounds contact pins 221 of the socket 300 (see FIG. 6) and which upon mounting of the plug connector 100 to the retainer 200 insider the socket 300 can receive the isolation tubes 122 of the connector housing 101 (shown in FIG. 2).

Figure 7:
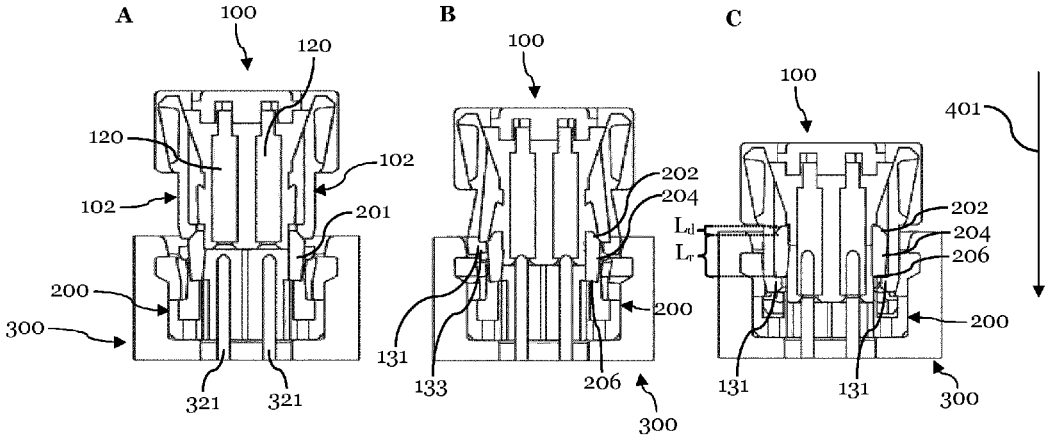
FIGS. 7A to 7C show cross-sectional views of a plug connector and an retainer inserted into an socket, whereby the mounting process of the plug connector is illustrated.

FIGS. 7A to 7C illustrate the insertion process of the plug connector 100 into the socket 300. As illustrated in these three figures, the retainer 200 is shown fully inserted in the socket 300 surrounding two contact pins 321 of the socket 300. For illustrative purposes, the contact terminals 121 of the plug connector 100 are not shown in the figures such that only the inside of the isolation tubes 122 is visible.

When the plug connector 100 is positioned as shown in FIG. 7A, angled surfaces 132 which are provided on latching projections 131 of the latching arms 102 abut deflection portions 202 of the retainer 200. The deflection portion 202 is shaped such that upon further insertion of the plug connector 100 in insertion direction 401 into the socket 300 the deflection portions 202 deflect the latching arms 102 outwardly. As it will be clear for the person skilled in the art, due to the deflection, the angled surfaces 133 are biased against the deflection portion 202 whereby upon further movement of the plug connector 100 in insertion direction 401, the deflection and thus the bias increases. More force is required to deflect the latching arms 102 further outwardly such that due to the deflection of the latching arms 102 and the bias of the angled surfaces 133 against the deflection portions 202, increasing resistance is provided against further movement of the plug connector 100 in insertion direction 401.

As illustrated in FIGS. 7A-7C, the deflection portion 202 is formed on a protruding portion 201, i.e. a Go/No Go member 201, next to a release portion 204. Thereby, the Go/No Go member 201 is shaped such that after the latching arm 102 has reached maximum deflection and the resistance has reached a threshold value, upon further movement of the plug connector 100 in insertion direction 401, the latching projections 131 abut the release portion 204 (see FIG. 7B). In other words, when the latching projection 131 of the latching arm 102 is positioned just in between the deflection portion 202 and the release portion 204, the deflection of the latching arm 202 is at its maximum such that the bias of the latching arm 102 is maximal. Thereby, the resistance provided by the deflection of the latching arm 102 reaches a threshold value just before the latching arm 102 abuts the release portion 204.

The threshold value may correspond to an insertion force within the range of 1 N to 100 N, preferably within the range of 10 N to 90 N, more preferably within the range of 20 N to 80 N, even more preferably within the range of 30 N to 70 N, yet even more preferably within the range of 30 N to 60 N, and most preferably within the range of 35 N to 45 N.

As shown in FIG. 7B, if the plug connector 100 is pressed in insertion direction 401 with a force exceeding the insertion force required to overcome the resistance, the latching projection 131 can be moved passed the deflection portion 202 such that the latching projection 131 comes into contact with the release portion 204. As one may derive from the figure, because the latching arms 102 are still deflected outwardly, they are biased against the release portions 204. Upon further movement of the plug connector 100 in insertion direction 401, due to the shape of the release portion 204, the latching arms 102 are free to bend inwardly. Due to an intrinsic tension of the latching arms 102 caused by the outward deflection by the deflection portion 202, the following inward deflection of the latching arms 102 follows automatically. Therefore, no extra force has to be applied and, in other words this deflection, i.e. the release deflection, does not provide any resistance against further movement of the plug connector 100 in insertion direction 401. As one may derive from FIG. 7C, upon full insertion of the plug connector 100 into the squib socket 300, the latching projections 131 snap inwardly behind latching portions 206 of the squib retainer 200 to lock the plug connector 100 to the retainer 200. Since the retainer 200 is provided with coupling members 231 (see FIGS. 4 and 5) to mechanically couple the retainer 200 to the socket 300, in assembled condition of the airbag connector as shown in FIG. 7C, the plug connector 100 is mechanically connected to the socket 300 only via the retainer 200.

As illustrated in FIGS. 7A to 7C, the deflection portion 202, the release portion 204 and the latching portions 206 are provided integrally on a go/no-go member 201, whereby the release portion 204 is disposed in between the deflection portion 202 and the latching portion 206. As described above, the go/no-go member 201 provides a go/no-go mechanism for the plug connector 100 upon movement of the plug connector 100 into the socket 300. If the plug connector 100 is placed in an initial position as shown in FIG. 7A and pressed from there into the socket 300 with an insertion force not exceeding the required threshold value, the plug connector 100 cannot be inserted into the socket 300. As shown in FIG. 7A, because the retainer 200 extends out of the socket 300 such that the angled surfaces 133 of the latching projections 131 abut the deflection portions 202 before the plug connector 100 is inserted into the socket 300, in the initial position of the plug connector 100, an electrical connection between contact pins 321 of the socket 300 and contact terminals 121 (not shown) cannot be not established.

In the case that the insertion force exceeds the threshold value, the plug connector 100 can be moved into the socket 300. Preferably, the force required to exceed the threshold value for insertion is so large such that if an operator pushes with this force, the plug connector 100 is directly pushed into its final position in which the latching projections 131 abut the latching portions 206 as shown in FIG. 7C.

As it will be clear to the person skilled in the art, to provide the above-described go/no-go mechanism, the dimensions of the go/no-go member 201 have to be chosen appropriately. As one can see in FIG. 7C, to this end, the deflection portion 202 has a length Ld and the release portion 204 has a length Lr, whereby both lengths are measured parallel to the insertion direction 401 of the plug connector 100 and whereby Ld is shorter than Lr. The ratio Ld/Lr may be within the range of 0.05 to 0.8, more preferably within the range of 0.1 to 0.75, even more preferably within the range of 0.15 to 0.5 and most preferably within the range of 0.2 to 0.3.

Figure 8:
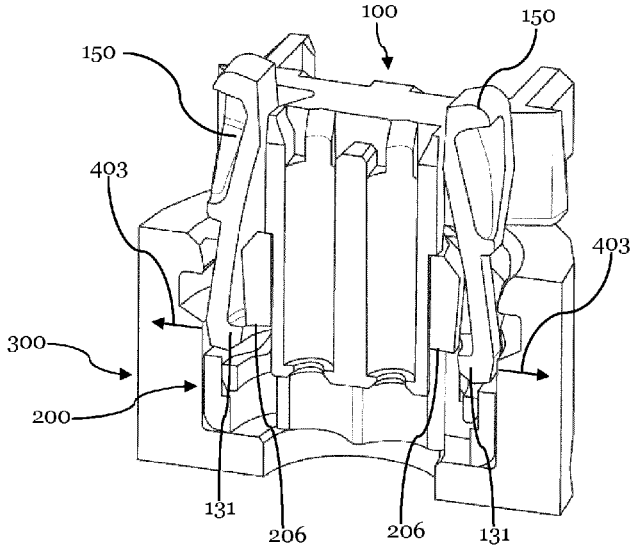
FIG. 8 shows a cut through an connector system with the plug connector partially mounted.

As illustrated in FIG. 8, the release members 150 of the latching arm 102 can be actuated by an operator, i.e. the release members 150 of the latching arms 102 can be pressed inwardly towards the connector housing 101, whereby, as one can see in this figure, the latching section, i.e. the latching projection 131 is released from the latching portion 206 by pivoting the latching arm 102 around the pivot member 201 (the flexible portions as visible in FIG. 1). If the release members 150 are actuated as shown in FIG. 8, the plug connector 100 is free to be removed out of the socket 300.

Figure 9:
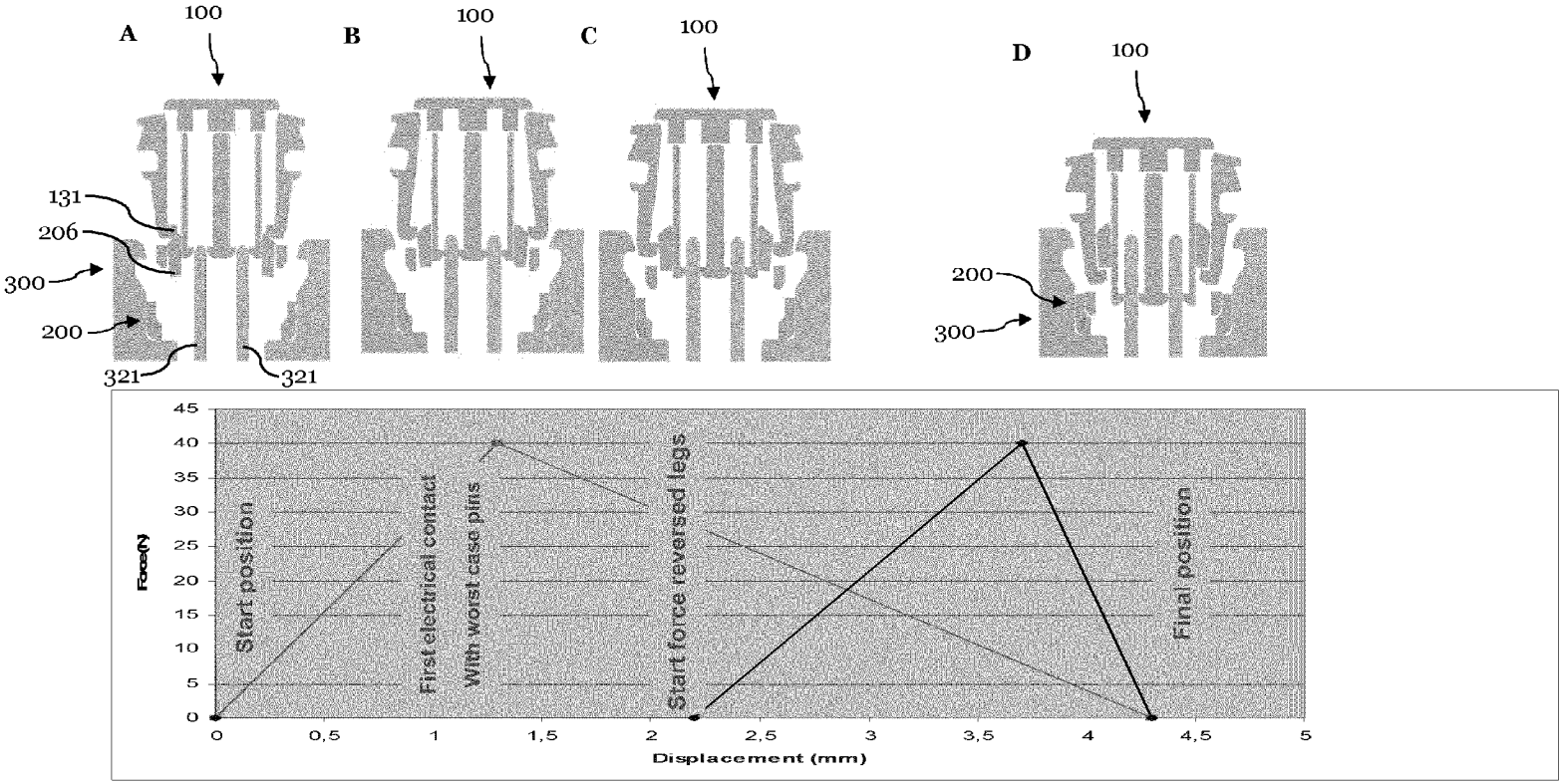
FIG. 9 shows a diagram illustrating the insertion force of the plug connector as a function of plug connector position with respect to the socket.

FIG. 9 shows a diagram illustrating the insertion force necessary for moving a plug connector 100 in insertion direction 401 into a socket 300 as a function of the plug connector 100 position with respect to socket 300.

As can be derived from FIG. 9 A, the latching projections 131 come into contact with deflection portions 202 before the plug connector 100 can be inserted into the socket 300. Thus, before the contact terminals (not shown) of the plug connector 100 can come into electrical contact with contact pins 321 of the socket 300, the insertion force increases linearly until a threshold value of 40 N is reached. Only if the insertion force exceeds this threshold value, the plug connector 100 can be inserted fully into the socket 300 such that the contact terminals 121 can come into full contact with contact pins 321. The diagram thus illustrates the go/no go mechanism as it is described above.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

The invention claimed is:

1. A connector system comprising a plug connector and an retainer configured to be inserted into a corresponding socket, the plug connector comprising a connector housing and at least one latching arm assigned to the connector housing, the plug connector configured to be mountable with the retainer, wherein the connector system comprises:

at least one deflection portion for causing a deflection of the latching arm upon mounting of the plug connector with the retainer, the deflection portion being shaped such that the deflection provides increasing resistance against further movement of the plug connector in mounting direction;

at least one release portion configured to enable a release deflection of the latching arm, the release portion being shaped such that the release deflection does not provide resistance against further movement of the plug connector; and at least one latching portion configured to allow latching of the latching arm for locking of the plug connector with the retainer, wherein the deflection portion has a first length and the release portion has a second length, both the first length and the second length measured parallel to the insertion direction of the plug connector, wherein the first length of the deflection portion is shorter than the second length of the release portion.

2. The connector system according to claim 1, wherein the deflection portion and the release portion are arranged such that upon mounting of the plug connector with the retainer the resistance provided by the deflection of the latching arm reaches a threshold value before the release deflection of the latching arm is enabled.

3. The connector system according to claim 1, wherein the deflection portion, the release portion and the latching portion are provided integrally on a Go/No Go member, whereby the release portion is disposed in between the deflection portion and the latching portion.

4. The connector system according claim 2, wherein the latching arm is provided with a latching projection which is configured to engage the deflection portion upon mounting of the plug connector with the retainer, such that the latching arm is deflected outwardly in a direction essentially perpendicular to the insertion direction.

5. The connector system according to claim 4, wherein upon engagement of the latching projection and the deflection portion, the latching projection is configured to be biased against the deflection portion, such that an outward deflection of the latching arm provides increasing resistance against further movement of the plug connector towards a mounted position.

6. The connector system according to claim 4, wherein upon mounting of the plug connector with the retainer, after the resistance provided by the deflection of the latching arm has reached the threshold value, the latching projection is configured to abut the release portion such that upon further movement of the plug connector, the latching projection slides along the release portion, whereby the latching arm is deflected inwardly.

7. The connector system according to claim 1, wherein a ratio of the first length to the second length is within a range of 0.05 to 0.8.

8. The connector system according to claim 2, wherein the threshold value corresponds to an insertion force within a range of 1 N to 100 N.

9. A connector system comprising a plug connector and an retainer configured to be inserted into a corresponding socket, the plug connector comprising a connector housing and at least one latching arm assigned to the connector housing, the plug connector configured to be mountable with the retainer, wherein the connector system comprises:

at least one deflection portion for causing a deflection of the latching arm upon mounting of the plug connector with the retainer, the deflection portion being shaped such that the deflection provides increasing resistance against further movement of the plug connector in mounting direction;

at least one release portion configured to enable a release deflection of the latching arm, the release portion being shaped such that the release deflection does not provide resistance against further movement of the plug connector; and at least one latching portion configured to allow latching of the latching arm for locking of the plug connector with the retainer, wherein the deflection portion and the release portion are arranged such that upon mounting of the plug connector with the retainer the resistance provided by the deflection of the latching arm reaches a threshold value before the release deflection of the latching arm is enabled, wherein the latching arm is provided with a latching projection which is configured to engage the deflection portion upon mounting of the plug connector with the retainer, such that the latching arm is deflected outwardly in a direction essentially perpendicular to the insertion direction and wherein upon mounting of the plug connector with the retainer after an interaction of the latching projection of the latching arm with the release portion, the latching projection is configured to latch behind the latching portion, thereby locking the plug connector to the retainer.

10. A connector system comprising:

a retainer configured to be inserted into a corresponding socket; and a plug connector, the plug connector comprising a connector housing, and at least one latching arm assigned to the connector housing, wherein the plug connector is configured to be mountable with the retainer and wherein the latching arm comprises an inwardly directed latching projection which is configured to be latched against a latching portion of the retainer when the plug connector is mounted with the retainer to lock the plug connector to the retainer.

11. The connector system according to claim 10, wherein the retainer comprises at least one deflection portion for causing a deflection of the latching arm upon mounting of the plug connector with the retainer.

12. The connector system according to claim 11, wherein the latching projection is configured to engage the deflection portion upon mounting of the plug connector with the retainer, such that the latching arm is deflected outwardly in a direction essentially perpendicular to the insertion direction.

13. The connector system according to claim 11, wherein the latching projection is provided with an angled surface which is configured to abut the deflection portion upon mounting of the plug connector with the retainer, such that an outward deflection of the latching arm in a direction essentially perpendicular to the insertion direction is facilitated.

14. The connector system according to claim 11, wherein the connector system comprises at least one release portion configured to enable a release deflection of the latching arm, the release portion being disposed in between the deflection portion and the latching portion.

15. The connector system according to claim 14, wherein the release portion and the latching portion are provided integrally on a Go/No Go member of the retainer.

16. The connector system according to claim 10 wherein the retainer is provided with coupling members to mechanically couple the retainer to the socket such that in assembled condition, the plug connector is mechanically connected to the socket via the latching interaction of latching projection and the latching portion.

17. The connector system according to claim 10, wherein the latching arm comprises a latching section configured to mechanically connect to the latching portion of the retainer, a release member configured to be actuated to release the latching section from the latching portion, whereby the latching arm is pivotably connected to the connector housing via a pivot member disposed between the latching section and the release member, such that upon actuation of the release member the latching section is released from the latching portion.

18. A connector system comprising:

a retainer configured to be inserted into a corresponding socket; and a plug connector, the plug connector comprising a connector housing, and at least one latching arm assigned to the connector housing, wherein the plug connector is configured to be mountable with the retainer and wherein the latching arm comprises a latching section, provided with a latching projection, configured to mechanically connect to a latching portion of the retainer; and a release member configured to be actuated to release the latching section from the latching portion whereby the latching arm is pivotably connected to the connector housing via a pivot member disposed between the latching section and the release member such that upon actuation of the release member the latching section is released from the latching portion.

19. The connector system according to claim 18, wherein the pivot member is an intermediate portion of the latching arm which is connected to the connector housing via at least one flexible connection bridge.

20. The connector system according to claim 18, wherein the latching section is provided with an inwardly oriented latching projection, which is configured to latch behind the latching portion of the retainer, thereby locking the plug connector to the retainer.

21. The connector system according to claim 18, wherein the retainer is provided with coupling members for mechanically coupling the retainer to the socket.

22. The connector system according to claim 18, wherein the plug connector is mechanically coupled to the socket via the retainer.

23. The connector system according to claim 18, wherein the retainer is provided with coupling members to mechanically couple the retainer to the socket such that in assembled condition, the plug connector is mechanically connected to the socket only via the retainer.

24. The connector system according to claim 18, wherein the connector system is free of locking elements for immediate mechanical coupling of the plug connector to the socket.

25. The connector system according to claim 18, wherein the plug connector comprises at least one contact element configured to electrically contact a contact member of the socket when the plug connector is mounted to the retainer and the retainer is mounted to the socket, wherein when the retainer is mounted to the socket, upon mounting of the plug connector to the retainer, the contact element does not come into electrical contact with the contact member when the plug connector is in a position in which the latching arm is deflected by a deflection portion.

26. The connector system according to claim 18, wherein the plug connector is a scoop-proof plug connector.

* * * * *